US009747865B2

(12) United States Patent
Sung et al.

(10) Patent No.: US 9,747,865 B2
(45) Date of Patent: Aug. 29, 2017

(54) GAMMA CORRECTION CIRCUIT AND GAMMA CORRECTION METHOD

(71) Applicant: MStar Semiconductor, Inc., Hsinchu Hsien (TW)

(72) Inventors: Tung Han Sung, Hsinchu County (TW); Shang-Chieh Wang, Hsinchu County (TW)

(73) Assignee: MStar Semiconductor, Inc., Hsinchu Hsien ( * ) Notice: Subject to any disclaimer, the term of this patent is extended or adjusted under 35 U.S.C. 154(b) by 223 days.

(21) Appl. No.: 14/727,986

(22) Filed: Jun. 2, 2015

(65) Prior Publication Data

US 2015/0356946 A1 Dec. 10, 2015

(30) Foreign Application Priority Data

Jun. 5, 2014 (TW) ..... 103119608 A

(51) Int. Cl.

*G09G 5/10* (2006.01)
*G09G 5/06* (2006.01)
*G09G 5/00* (2006.01)

(52) U.S. Cl.

CPC ..... *G09G 5/06* (2013.01); *G09G 5/006* (2013.01); *G09G 2320/0673* (2013.01); *G09G 2330/026* (2013.01)

(58) Field of Classification Search

CPC ..... G09G 5/06
USPC ..... 345/690
See application file for complete search history.

(56) References Cited

U.S. PATENT DOCUMENTS 6,215,468 B1 * 4/2001 Van Mourik ..... H04N 9/69 345/605
9,343,024 B2 * 5/2016 Lee ..... G09G 5/10
2005/0151711 A1 7/2005 Baek
2006/0103683 A1 * 5/2006 Kang ..... G09G 3/2003 345/690
2009/0207191 A1 * 8/2009 Zarubinsky ..... H04N 5/202 345/690
2010/0225663 A1 * 9/2010 Lee ..... G09G 3/2003 345/596

(Continued)

FOREIGN PATENT DOCUMENTS

CN 1934607 3/2007

OTHER PUBLICATIONS

Taiwan Intellectual Property Office, Office Action dated Mar. 22, 2016.

*Primary Examiner* — Jason Olson
(74) *Attorney, Agent, or Firm* — WPAT, PC

(57) ABSTRACT

A gamma correction circuit applied to a display device includes a first storage unit, a second storage unit, a first correction circuit and a second correction circuit. The first storage unit stores a first gamma look-up table, and the second storage unit stores a second gamma look-up table. The first correction circuit receives an input signal, and generates an intermediate signal corresponding to the input signal according to the first gamma look-up table. The second correction circuit receives the intermediate signal, and generates an output signal corresponding to the intermediate signal according to the second look-up table to a display panel. The first look-up table is stored to the first storage unit after the display device is powered on.

20 Claims, 6 Drawing Sheets

(56) References Cited

U.S. PATENT DOCUMENTS

| | | | | |
|---|---|---|---|---|
| 2011/0102478 | A1* | 5/2011 | Huang | G09G 3/2003 345/690 |
| 2012/0249574 | A1* | 10/2012 | Botzas | G09G 3/20 345/605 |
| 2013/0076864 | A1* | 3/2013 | Takahashi | G09G 3/003 348/46 |

* cited by examiner

GAMMA CORRECTION CIRCUIT AND GAMMA CORRECTION METHOD

This application claims the benefit of Taiwan application Serial No. 103119608, filed Jun. 5, 2014, the subject matter of which is incorporated herein by reference.

BACKGROUND OF THE INVENTION

Field of the Invention

The invention relates in general to a display device, and more particularly to a gamma correction circuit and a gamma correction method for a display device.

Description of the Related Art

To compensate display differences of luminance/colors among different display devices and to present an image with preferred results on different display devices, a common display device includes a gamma correction circuit that generates a corresponding output luminance signal according to a grayscale signal. In practice, gamma correction is performed by utilizing a gamma look-up table. Per customer requests, multiple different sets of gamma look-up tables are usually generated at a factory production end according to different display panels and different display standards. These gamma look-up tables are stored to an electrically-erasable programmable read-only memory (EEPROM) coupled to a display panel to allow the display panel to support different display standards. The so-called "display standards" refer to different gamma values, e.g., 1.8, 2.0, 2.2, 2.4 . . . etc. However, the act of simultaneously storing multiple sets of gamma look-up tables to an EEPROM not only causes a production load (e.g., sequentially storing three gamma look-up tables respectively corresponding to 1.8, 2.0 and 2.2 to the EEPROM) that undesirably affects the production throughput, but also results in higher costs due to costs of the EEPROM. Therefore, there is a need for a solution for reducing the production load as well as the costs.

SUMMARY OF THE INVENTION

The invention is directed to a gamma correction circuit and a gamma correction method for solving issues of a conventional solution.

According to an embodiment the present invention, a gamma correction circuit for a display device includes a first storage unit, a second storage unit, a first correction circuit and a second correction circuit. The first storage unit stores a first gamma look-up table, and the second storage unit stores a second gamma look-up table. The first correction circuit receives an input signal, and generates an intermediate signal corresponding to the input signal according to the first gamma look-up table. The second correction circuit receives the intermediate signal, and generates an output signal corresponding to the intermediate signal according to the second gamma look-up table. The first gamma look-up table is stored to the first storage unit after the display device is powered on.

According to another embodiment of the present invention, a gamma correction method includes: generating a first gamma look-up table and storing the first gamma look-up table to a first storage unit; receiving an input signal, and generating an intermediate signal corresponding to the input signal according to the first gamma look-up table; and receiving the intermediate signal, and generating an output signal corresponding to the intermediate signal according to a second gamma look-up table stored in a second storage unit.

According to another embodiment of the present invention, a gamma correction method for a display device includes: determining a gamma setting value; determining a first gamma look-up table according to the gamma setting value; and performing gamma correction on the display device according to the first gamma look-up table and the second gamma look-up table. The first gamma look-up table is non-associated with display characteristics of the display device.

The above and other aspects of the invention will become better understood with regard to the following detailed description of the preferred but non-limiting embodiments. The following description is made with reference to the accompanying drawings.

DETAILED DESCRIPTION OF THE INVENTION

Throughout the specification and the appended claims, certain terms are utilized for referring to specific elements. A person having ordinary skill in the art can easily appreciate that, different terms may be used by hardware manufacturers to refer to a same element. Differences in those terms in the specification and the appended claims are not to be construed for distinguishing the elements, and the elements are in fact differentiated based on functional differences. Throughout specification and the appended claims, the term "comprise" is regarded as an open-end term to be explained as "include but not limited to". Further, the term "couple" includes any means of direct and indirect electrical connections. Therefore, if it is described that a first device is coupled to a second device, it means that the first device may be electrically connected to the second device in a direct manner, or in an indirectly manner through other devices and connection means.

Figure 1:
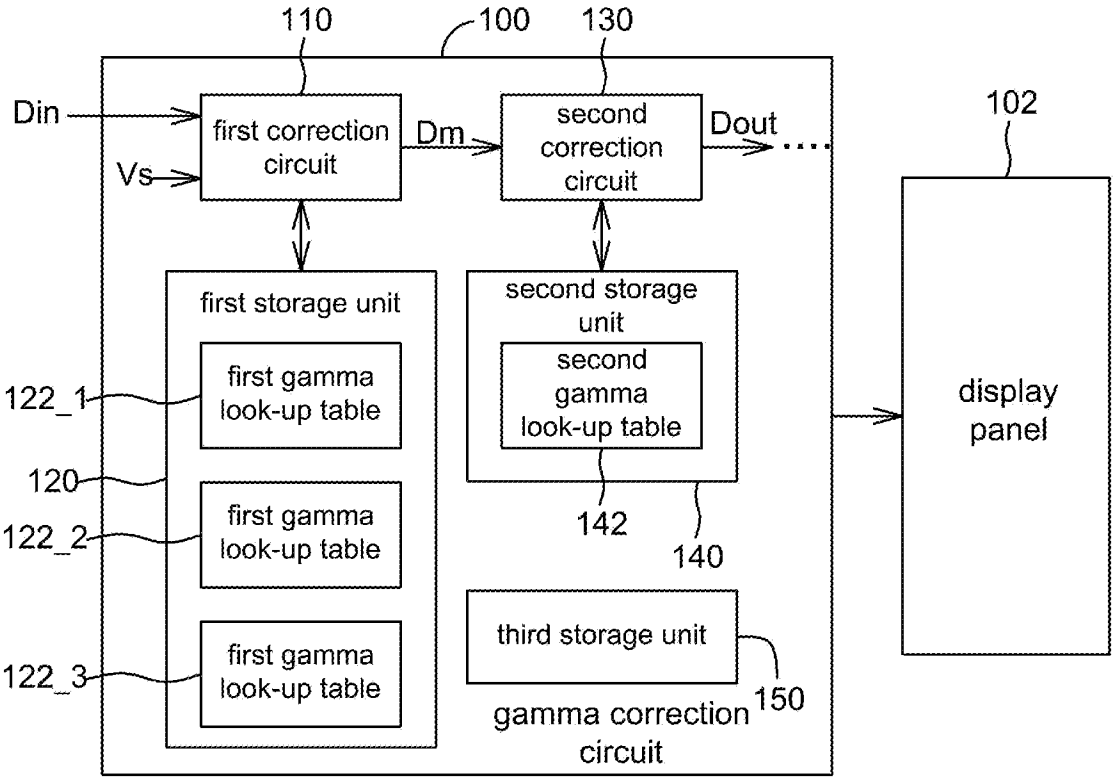
FIG. 1 is a schematic diagram of a gamma correction circuit according to an embodiment of the present invention.

FIG. 1 shows a schematic diagram of a gamma correction circuit 100 according to an embodiment of the present invention. As shown in FIG. 1, the gamma correction circuit 100, coupled to a display panel 102, includes a first correction circuit 110, a first storage unit 120, a second correction circuit 130, a second storage unit 140 and a third storage unit 150. The first storage unit 120 includes multiple first gamma look-up tables (e.g., three first gamma look-up tables 122_1, 122_2 and 122_3 in this embodiment), and the second storage unit 140 includes a second gamma look-up table 142. The three first gamma look-up tables 122_1, 122_2 and 122_3 correspond to different gamma values. In the embodiment, for example, the first storage unit 120 is implemented by a static random access memory (SRAM), the second storage unit 140 is implemented by an electrically-erasable programmable read-only memory (EEPROM), and the third storage unit 150 is implemented by a read-only memory (ROM). In one embodiment, the gamma correction circuit 100 and the display panel 102 are included in a display device.

Figure 2:
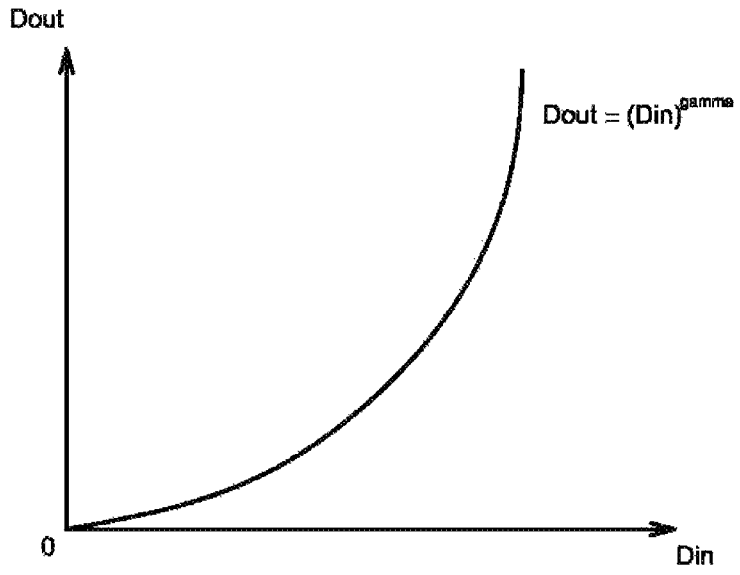
FIG. 2 is a relationship diagram between an output signal and an input signal of a gamma correction circuit.

Operation details of the gamma correction circuit 100 are given with reference to FIG. 2 below. Referring to FIG. 2, the gamma correction circuit 100 performs gamma correction on an input signal Din to generate a first output signal Dout, which is subsequently processed by other components and then transmitted to the display panel 102. A relationship between the output signal Dout and the input signal Din is represented as $Dout=(Din)^{gamma}$, where gamma is referred to as a gamma value. According to characteristics of display panels and customer requirements, the gamma value is usually 2.2, and may also be other values such as 1.9, 2.0, 2.1, 2.4 . . . etc. In FIG. 1 and FIG. 2, the input signal Din represents a grayscale signal, and the output signal Dout represents a display luminance signal. Further, the input signal Din and the output signal Dout shown in FIG. 1 and FIG. 2 may be scaled or normalized grayscale signal and display luminance signal, respectively. Other associated details of the significance and operations of gamma correction are generally known to one person skilled in the art, and shall be omitted herein.

The first gamma look-up tables 122_1, 122_2 and 122_3 in FIG. 1 are set and stored in advance in the third storage unit 150 at a developer end and then stored to the first storage unit 120 after the display device is powered on. On the other hand, the second look-up table 142 is written into the second storage unit 140 at a production end. In the embodiment, one of the first gamma look-up tables 122_1, 122_2 and 122_3 is selected through determining a gamma setting value, and the gamma correction circuit 100 may selectively generate the output signal Dout corresponding to three different gamma values. More specifically, assuming that the gamma correction circuit 100 needs to selectively generate the output signal Dout corresponding to gamma values N1, N2 and N3, the gamma value corresponding to the second gamma look-up table 142 is L, and N1+K1*L, N2=K3*L, and N3=K3*L. Taking an actual example, assuming that the gamma correction circuit 100 needs to selectively generate the output signal Dout corresponding to gamma values 2.0, 2.2 and 2.4, the gamma value corresponding to the second gamma look-up table may be 2.2, and the gamma values corresponding to the first gamma look-up tables 122_1, 122_2 and 122_3 are respectively about 0.9, 1 and 1.1. That is, when the gamma correction circuit 100 needs to generate the output signal Dout corresponding to the gamma value 2.0, the first gamma look-up table 122_1 may be utilized; when the gamma correction circuit 100 needs to generate the output signal Dout corresponding to the gamma value 2.2, the first gamma look-up table 122_2 may be utilized; when the gamma correction circuit 100 needs to generate the output signal Dout corresponding to the gamma value 2.4, the first gamma look-up table 122_3 may be utilized.

Operations for selecting the first gamma look-up tables 122_1, 122_2 and 122_3 can be performed by following approaches. In one approach, when the display device is powered on, one of the first gamma look-up tables 122_1, 122_2 and 122_3 stored in the third storage unit 150 is selected, and the selected first look-up table is loaded to the first storage unit 120 for subsequent use (at this point, the first storage unit 120 stores only one first gamma look-up table). In another approach, when the display device is powered on, all of the first gamma look-up tables 122_1, 122_2 and 122_3 stored in the third storage unit 150 are loaded into the first storage unit 120, and one of the first gamma look-up tables 122_1, 122_2 and 122_3 stored in the first storage unit 120 is then selected.

In the above non-limiting embodiment, the first gamma look-up tables 122_1, 122_2 and 122_3 are already set and stored in advance in the third storage unit 150 at a developer end as an example for explaining the present invention. In another embodiment, instead of storing the first gamma look-up table, the third storage unit 150 stores multiple equations, e.g., $Dm=(Din)^{gamma_1}$, $Dm=(Din)^{gamma_2}$, $Dm=(Din)^{gamma_3}$ . . . etc, where gamma_1, gamma_2 and gamma_3 are respectively different gamma values. When the display device is powered on, a control circuit (not shown) selects one of the multiple equations stored in the third storage unit 150, generates a first gamma look-up table according to the selected equation, and loads the first gamma look-up table to the first storage unit 120 for subsequent use. Alternatively, when the display device is powered on, a control circuit generates multiple first gamma look-up tables according to the multiple equations stored in the third storage unit 150, loads the multiple first gamma look-up tables (e.g., the first gamma look-up tables 122_1, 122_2 and 122_3 in FIG. 1) to the first storage unit 120, and selects and utilizes one of the multiple first gamma look-up tables 122_1, 122_2 and 122_3 stored in the first storage unit 120.

In the embodiment, the first gamma look-up tables 122_1, 122_2 and 122_3 respectively records multiple corresponding values of the input signal Din and the intermediate signal Dm, and the second gamma look-up table 142 records multiple corresponding values of the intermediate signal Dm and the output signal Dout. Operations of the gamma correction circuit 100 are described in detail below. The first correction circuit 110 first receives the input signal Din, and selects one of the first gamma look-up tables 122_1, 122_2 and 122_3 according to a selection signal to generate an intermediate signal Dm corresponding to the input signal Din. The relationship between the input signal Din and the intermediate signal Dm is substantially $Dm=(Din)^{gamma_1}$, wherein gamma_1 is the corresponding gamma value in the selected first gamma look-up table. In the embodiment, assuming the selected first gamma look-up table is 122_1, the value of gamma_1 is 0.9; assuming the selected gamma table is 122_2, the value of gamma_1 is 1; assuming the selected first gamma look-up table is 122_3, the value of gamma_1 is 1.1. The second correction circuit 130 receives the intermediate signal Dm, and generates an output signal Dout corresponding to the intermediate signal Dm according to the second gamma look-up table 142. The relationship between the intermediate signal Dm and the output signal Dout is substantially $Dout=(Dm)^{gamma_2}$, where gamma_2 is the corresponding gamma value in the second gamma look-up table 142. In the embodiment, the value of gamma_2 is 2.2.

Figure 3:
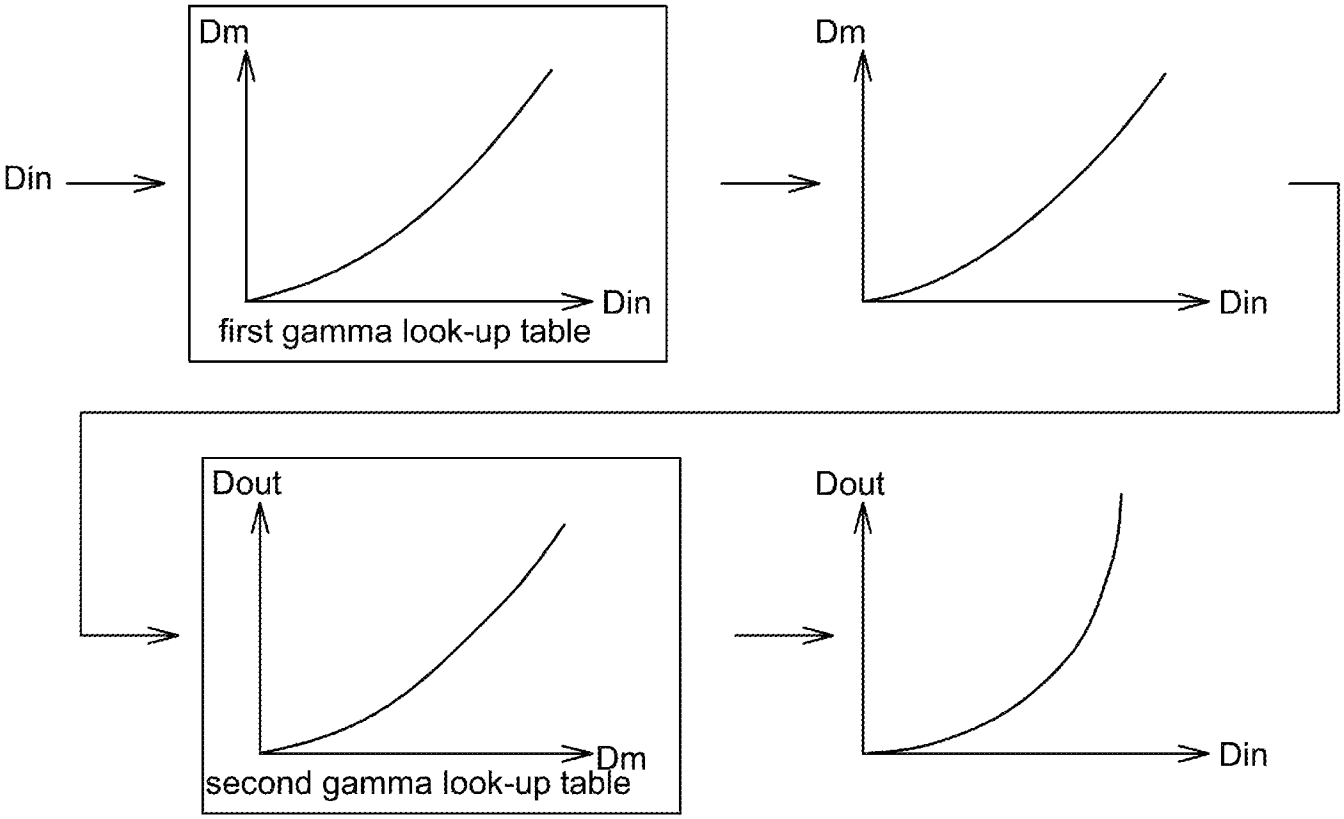
FIG. 3 is a schematic diagram of operations of a gamma correction circuit.

Operation Concepts of the Present Invention are Depicted in FIG. 3

With the gamma correction operations respectively performed by the first correction circuit 110 and the second correction circuit 130, an output signal satisfying a required standard as well as an output signal corresponding to gamma values 2.0, 2.2 and 2.4 can be generated. Further, only the second gamma look-up table 142 needs to be written to the second storage unit 140. Thus, compared to a conventional technique of writing multiple gamma look-up tables to a storage unit at a production end, the present invention is capable of achieving an effect of supporting multiple gamma standards (multiple gamma values) by consuming the time for writing only one gamma look-up table, thereby reducing the operation time at a production end.

It should be noted that, the operation sequences of the first correction circuit 110 and the second correction circuit 130 may be exchanged. That is, in another embodiment of the present invention, the second correction circuit 130 first generates the intermediate signal Dm corresponding to the input signal Din according to the second gamma look-up table 142, and the first correction circuit 110 then generates the output signal Dout corresponding to the intermediate signal Dm according to one of the first gamma look-up tables 122_1~122_3. The above design variations are to be encompassed within the scope of the present invention.

It can be understood from the description of the above embodiments that, the first gamma look-up tables 122_1~122_3 are for collaborating with the second gamma look-up table 142 to generate an output signal corresponding to multiple different standards. Further, the first gamma look-up tables 122_1~122_3 are non-associated with display characteristics of the display panel 102 (or the display device). In other words, on display panels of different batch numbers, different display panels or display panels of different designs, the same signal may produce different gray-scale luminances or a curve different from the curve in FIG. 2 (i.e., different display characteristics). More specifically, the second gamma look-up table 142 loaded at a production end is designed according to the display characteristics of the display panel 102, whereas the first gamma look-up tables 122_1~122_3 are non-associated with the display characteristics of the display panel 102.

Figure 4:
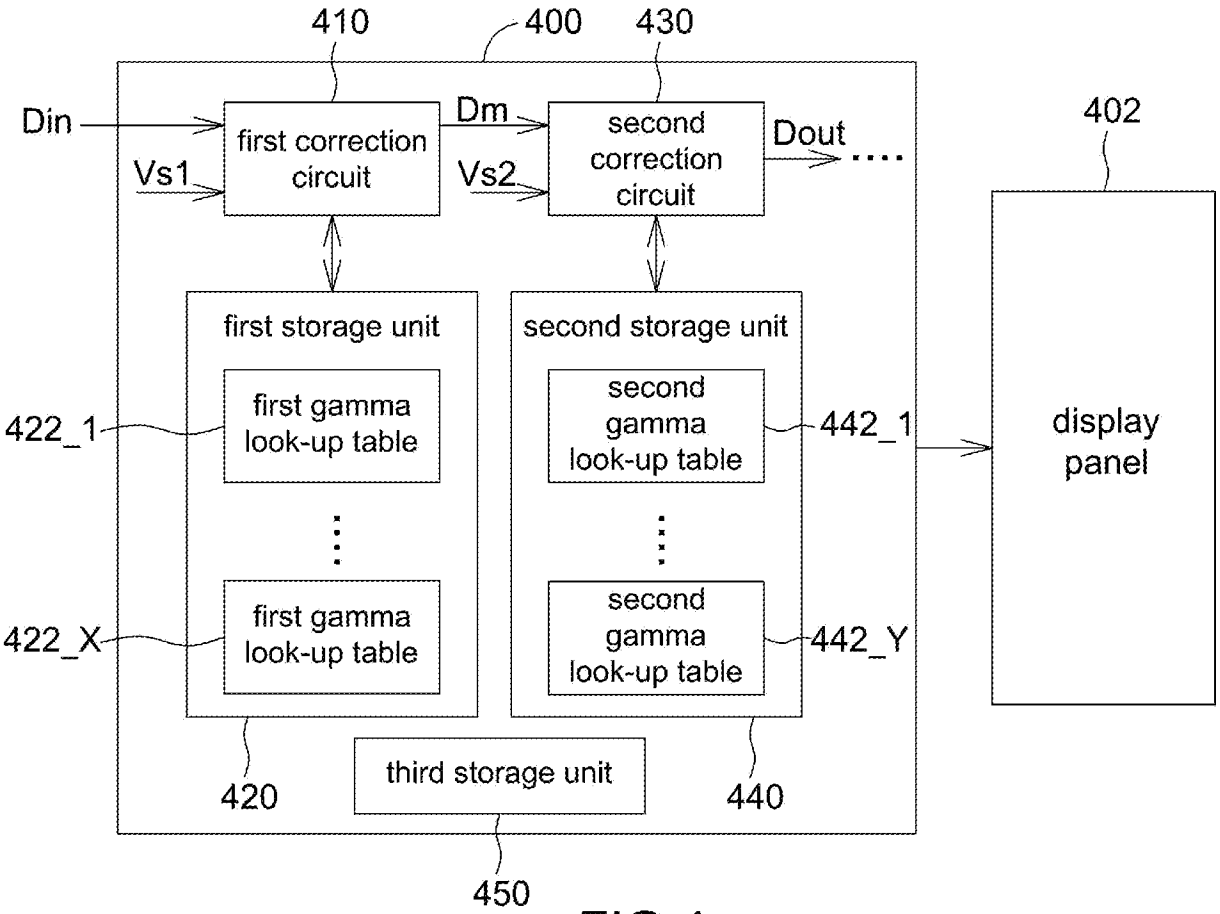
FIG. 4 is a schematic diagram of a gamma correction circuit according to another embodiment of the present invention.

Based on the above operation concepts, the present invention further discloses an embodiment shown in FIG. 4. FIG. 4 shows a schematic diagram of a gamma correction circuit 400 according to another embodiment of the present invention. As shown in FIG. 4, the gamma correction circuit 400, coupled to a display panel 402, includes a first correction circuit 410, a first storage unit 420, a second correction circuit 430, a second storage unit 440 and a third storage unit 450. The first storage unit 420 includes an X number of first gamma look-up tables 422_1~422_X, and the second storage unit 440 includes a Y number of second gamma look-up tables 442_1~442_Y, where X and Y are positive integers greater than 1. The X number of first gamma look-up tables correspond to different gamma values, and the Y number of second gamma look-up tables also corresponding to different gamma values. In the embodiment, for example, the first storage unit 420 is implemented by an SRAM, the second storage unit 440 is implemented by an EEPROM, and the third storage unit 150 is implemented by a ROM. In one embodiment, the gamma correction circuit 400 and the display panel 402 are included in a display device.

The first gamma look-up table 422_1~422_X in FIG. 4 are set and stored in advance in the third storage unit 450 at a developer end, and then stored to the first storage unit 420 after the display device is powered on. On the other hand, the second gamma look-up tables 442_1~442_Y are written to the second storage unit 440 at a production end. In the embodiment, through selecting one of the first gamma look-up tables 422_1~422_X by a first selection signal Vs1 and selecting one of the second gamma look-up tables 442_1~442_Y by a second selection signal Vs2, the gamma correction circuit 400 may selectively generate the output signal Dout corresponding to (X*Y) different gamma values. Detail operations of the gamma correction circuit 400 can be easily understood by one person skilled in the art with reference to the disclosure associated with FIG. 1 to FIG. 3, and shall be omitted herein.

Similar to the embodiment in FIG. 1, with the gamma correction operations respectively performed by the first correction circuit 410 and the second correction circuit 420 of the gamma correction circuit 400, an output signal satisfying multiple gamma standards can be generated. Further, only the Y number of second gamma look-up tables 442_1~442_Y need to be written to the second storage unit at a production end. Thus, compared to a conventional technique that needs to write (X*Y) gamma look-up tables at the production end, the present invention is capable of achieving an effect of supporting (X*Y) gamma standards (multiple gamma values) by consuming the time for writing only the Y number of gamma look-up tables, thereby reducing the operation time at a production end.

Figure 5:
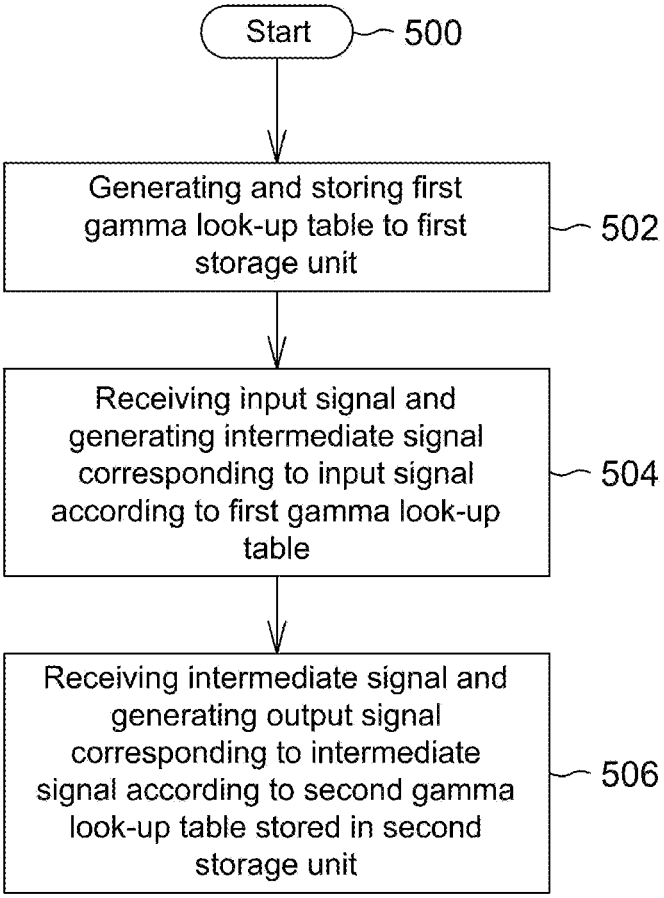
FIG. 5 is a flowchart of a gamma correction method according to an embodiment of the present invention.

FIG. 5 shows a flowchart of a gamma correction method according to an embodiment of the present invention. Referring to FIG. 1 to FIG. 5, a process of the gamma correction method of the present invention includes following steps.

In step 500, the process begins.

In step 502, a first gamma look-up table is generated and stored to a first storage unit.

In step 504, an input signal is received, and an intermediate signal corresponding to the input signal is generated according to the first gamma look-up table.

In step 506, the intermediate signal is received, and an output signal corresponding to the intermediate signal is generated according to a second gamma look-up table stored in a second storage unit.

Figure 6:
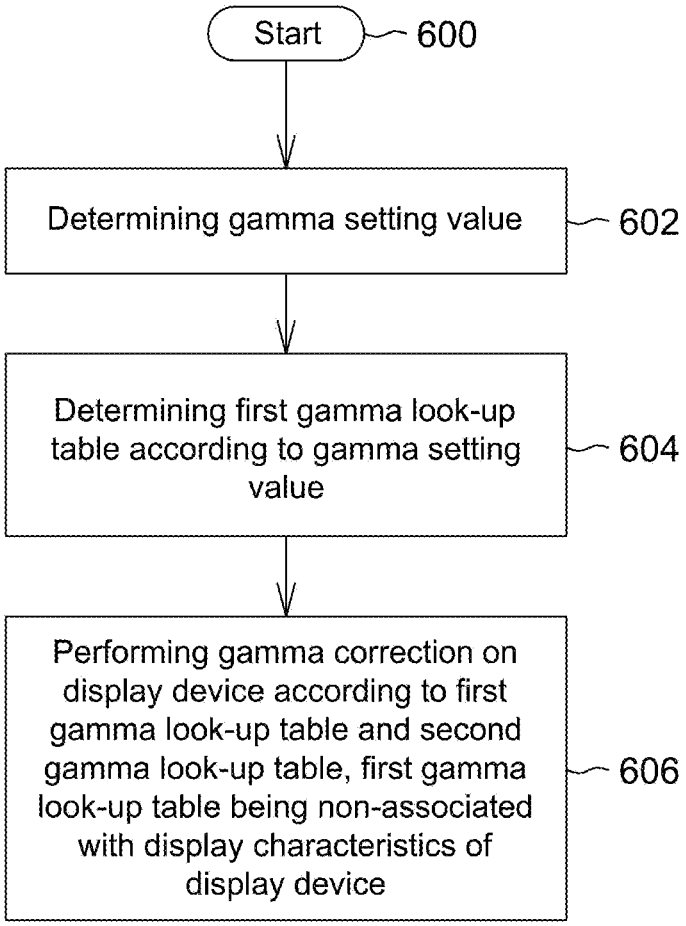
FIG. 6 is a flowchart of a gamma correction method according to another embodiment of the present invention.

FIG. 6 shows a flowchart of a gamma correction method according to another embodiment of the present invention. Referring to FIG. 1 to FIG. 5, a process of the gamma correction method of the present invention includes following steps.

In step 600, the process begins.

In step 602, a gamma setting value is determined.

In step 604, a first gamma look-up table is determined according to the gamma setting value.

In step 606, gamma correction is performed on a display device according to the first gamma look-up table and the second gamma look-up table. The first gamma look-up table is non-associated with display characteristics of the display device.

In conclusion, in the gamma correction circuit and the gamma correction method of the present invention, the object of gamma correction is achieved by two gamma correction processes. The first gamma look-up table utilized by the first gamma correction process is written to the third storage unit at a developer end and then loaded to the first storage unit after the display device is powered on. The second gamma look-up table utilized by the second gamma correction process is only written to the second storage unit at a production end. Thus, compared to a conventional technique of writing multiple gamma look-up tables at a production line, the present invention significantly reduces the operation time at the production end.

While the invention has been described by way of example and in terms of the preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A gamma correction circuit, applied to a display device, comprising:

a first storage unit, configured to store a first gamma look-up table, wherein the first gamma look-up table is unassociated with display characteristics of the display device;

a second storage unit, configured to store a second gamma look-up table associated with said display characteristics of the display device;

a first correction circuit, configured to receive an input signal and to generate an intermediate signal corresponding to the input signal according to the first gamma look-up table; and a second correction circuit, configured to receive the intermediate signal and to generate an output signal corresponding to the intermediate signal according to the second gamma look-up table, wherein the first gamma look-up table is stored to the first storage unit after the display device is powered on.

2. The gamma correction circuit according to claim 1, further comprising a third storage unit configured to store an equation, the gamma correction circuit generating the first gamma look-up table according to the equation.

3. The gamma correction circuit according to claim 1, for generating the output signal corresponding to a gamma value N, wherein the first gamma look-up table corresponds to a gamma value K, the second gamma look-up table corresponds to a gamma value L, and N=K*L.

4. The gamma correction circuit according to claim 1, wherein the first storage unit stores first alternative look-up tables, and the first correction circuit selects the first gamma look-up table from the first alternative look-up tables according to a first selection signal and accordingly generates the intermediate signal, the first alternative look-up tables each comprise different contents, when the first selection signal corresponds to a first target gamma value, the output signal has said first target gamma value, and when the first selection signal corresponds to a second target gamma value, the output signal has said second target gamma value.

5. The gamma correction circuit according to claim 4, wherein the second storage unit stores second alternative look-up tables, and the second correction circuit selects the second gamma look-up table from the second alternative look-up tables according to a second selection signal and accordingly generates the output signal.

6. The gamma correction circuit according to claim 1, wherein the first storage unit is implemented by a static random access memory (SRAM).

7. The gamma correction circuit according to claim 1, wherein the second storage unit is implemented by an electrically-erasable programmable read-only memory (EEPROM).

8. A gamma correction method, applied to a display device, comprising:

generating a first gamma look-up table, unassociated with display characteristics of the display device;

storing said first gamma lookup table to a first storage unit;

receiving an input signal;

generating an intermediate signal corresponding to the input signal according to the first gamma look-up table; and generating an output signal corresponding to the intermediate signal according to a second gamma look-up table associated with said display characteristics of the display device stored in a second storage unit.

9. The gamma correction method according to claim 8, further comprising:

generating the first gamma look-up table according to an equation;

wherein, the equation is stored in a third storage unit.

10. The gamma correction method according to claim 8, for generating the output signal corresponding to a gamma value N, wherein the first gamma look-up table corresponds to a gamma value K, the second gamma look-up table corresponds to a gamma value L, and N=K*L.

11. The gamma correction method according to claim 8 further comprising:

generating and storing first alternative look-up tables to the first storage unit;

wherein the step of generating the intermediate signal corresponding to the input signal according to the first gamma look-up table further comprises selecting the first gamma look-up table from the first alternative look-up tables according to a first selection signal and accordingly generating the intermediate signal;

wherein when the first selection signal corresponds to a first target gamma value, the output signal has said first target gamma value, and when the first selection signal corresponds to a second target gamma value, the output signal has said second target gamma value.

12. The gamma correction method according to claim 11, the second storage unit storing second alternative look-up tables, the gamma correction method further comprising:

selecting the second gamma look-up table from the second alternative look-up tables and according to a second selection signal and accordingly generating the output signal.

13. The gamma correction method according to claim 8, wherein the first storage unit is implemented by an SRAM.

14. The gamma correction method according to claim 8, wherein the second storage unit is implemented by an EEPROM.

15. The gamma correction method of claim 8, further comprising: installing a third memory preconfigured to perform said step of generating said first gamma look-up table in said display device, wherein said third memory is non-transitory; determining a grayscale-to-luminance display characteristic of said display device after installing said third memory; generating said second gamma table according to said grayscale-to-luminance display characteristic.

16. The gamma correction method of claim 15, wherein said first memory is static random access memory, said second memory is electrically-erasable programmable read-only memory, and said third memory is read-only memory.

17. A gamma correction method, applied to a display device, comprising:

determining a gamma setting value;

determining a first gamma look-Lip table according to the gamma setting value;

performing gamma correction on the display device according to the first gamma look-up table and a second gamma look-up table associated with display characteristics of the display device;

wherein, the first gamma look-up table is unassociated with display characteristics of the display device.

18. The gamma correction method according to claim 17, wherein the first gamma look-up table is stored to a first storage unit when the display device is powered on.

19. The gamma correction method according to claim 17, wherein the first gamma look-up table is generated according to an equation.

20. The gamma correction method according to claim 17, wherein the gamma setting value is N, the first gamma look-up table corresponds to a gamma value K, the second gamma look-up table corresponds to a gamma value L, and N=K*L.

* * * * *